US005380094A

United States Patent [19]

Schmidt et al.

[11] Patent Number: 5,380,094

[45] Date of Patent: Jan. 10, 1995

[54] EASY OPEN FEATURE FOR POLYMERIC PACKAGE WITH CONTENTS UNDER HIGH COMPRESSION

[75] Inventors: Edward H. Schmidt, Cincinnati, Ohio; Joseph B. Mercer, Hickory, N.C.

[73] Assignee: The Procter & Gamble Company, Cincinnati, Ohio

[21] Appl. No.: 191,238

[22] Filed: Feb. 3, 1994

[51] Int. Cl.[6] ..... B65D 30/18

[52] U.S. Cl. ..... 383/209; 206/83.5; 206/494

[58] Field of Search ..... 383/209; 206/83.5, 494; 229/87.05, 235

[56] References Cited

U.S. PATENT DOCUMENTS

| | | | |
|---|---|---|---|
| 2,699,285 | 1/1955 | Bell at al. | 229/87.05 |
| 3,072,248 | 1/1963 | Bishop | 383/209 |
| 3,124,242 | 3/1964 | Gottily | 383/209 |
| 3,162,539 | 12/1964 | Repko | 383/209 |
| 4,624,365 | 11/1986 | Derdyk | 206/494 |
| 5,054,619 | 10/1991 | Muckenfuhs | 383/207 |

*Primary Examiner*—Stephen P. Garbe

*Attorney, Agent, or Firm*—Jeffrey V. Bamber; Steven W. Miller; E. Kelly Linman

[57] ABSTRACT

An improved top opening, rectangular flexible bag for containing a stack of highly compressed flexible articles. The bag has front and back panels, two side panels and top and bottom panels, all of which are connected together to form an internal compartment for containing the stack under high compression. The stack is arranged within the bag in such a way that the side panels are under tension. The line of weakness defines the entire top portion of the bag which can be easily removed, thus exposing the entire contents of the bag for easy removal. The improvement to the bag is that the line of weakness is applied to the front and back panel of the bag simultaneously, thus providing perfect alignment of the lines of weakness where they intersect the side seals of the bag. The bag is further improved with a notch where the line of weakness intersects the side seal, thus significantly reducing the force to initiate the tear through the bead of plastic created by the side seal. A further improvement is that the line of weakness is applied in the machine direction as the bag is manufactured, thus requiring a simple, inexpensive, rotary cutting tool rather than an expensive, reciprocating die, and without negatively impacting line speeds.

1 Claim, 3 Drawing Sheets

EASY OPEN FEATURE FOR POLYMERIC PACKAGE WITH CONTENTS UNDER HIGH COMPRESSION

FIELD OF THE INVENTION

The present invention relates to an easy open flexible bag for containing a number of compressible articles such as disposable baby diapers, adult incontinent pads, sanitary napkins and the like. The present invention further relates to such an easy open bag wherein the articles are compressed in a direction parallel to their thickness and remain compressed until activation of the easy open feature. The present invention further relates to such an easy open flexible bag, which in use, may have the full amount of the contents removed at a single time.

BACKGROUND ART

Relatively soft and flexible compressible articles such as disposable diapers, catamenial pads, adult incontinent pads and the like, have entered widespread use in many parts of the world over the last 20–30 years. In the past, these articles were typically folded at their midpoint, collected in stacks and inserted into paperboard cartons or flexible bags or in the case of adult incontinent pads, packed bulk into corrugated containers. Pads were subject to little or no compression in a direction parallel to their thickness and the dimensions of the canons, bags or containers were generally determined by the number of articles contained in the stack or stacks contained within.

The bulk of the relatively low density flexible compressible articles in question has resulted in packages with high volume and low weight. This combination increases shipping, storage and handling costs for the manufacturer and the retailer, and detracts from the convenience of storage and use for the consumer. In addition, the relatively large volume of packaging material required for the disposable articles in an uncompressed condition, must be disposed of when the package has been fully emptied. Moreover, such excess packaging causes an undue amount of waste and is a burden on the environment.

Recently, in order to reduce package volume and its associated high costs, manufacturers have begun to package relatively high numbers of disposable articles under high compression in smaller, flexible plastic bags. An example of such a bag is described in U.S. Pat. No. 5,054,619 SIDE OPENING FLEXIBLE BAG WITH LONGITUDINALLY ORIENTED CARRYING HANDLE SECURED TO SIDE PANELS, issued to Muckenfuhs on Oct. 8, 1991, which is hereby incorporated herein by reference. This reference discloses a side opening top gusset flexible plastic bag containing a stack of compressed flexible articles. The bag has top, bottom, front, back and side panels, wherein the side panels am under tension caused by the compressed articles contained therein. The bag has a continuous line of weakness located at least partially on one of the side panels to define a portion of the side panel which will be partially removed to gain access to the articles. These types of bags typically include a pull tab on the side panel for initiating the opening of the bag.

While the bag described in the Muckenfuhs patent works quite well, a drawback to the general types of packages described above is that the opening feature exposes only a portion of the pads for dispensing one or two at a time. Additionally, the perforation or line of weakness of the opening feature is typically applied in a cross machine direction as the bag is manufactured, thus requiring expensive tooling and potentially limiting production speeds.

Product for a significant portion of the adult incontinent market is sold through hospitals and nursing homes where the entire contents of the package are dispensed immediately upon opening the bag. As such, an easy open feature that exposes all pads for removal is desirable.

It is therefore an object of the present invention to provide a top opening feature that is easy to initiate and where the entire top portion of the bag can be easily removed.

It is another object of the invention to apply the line of weakness for the easy open feature in a direction parallel to the compressive forces of the bag, thus optimizing the line of weakness without danger of premature opening.

It is another object of the invention to provide the easy open feature such that the bag manufacturer can apply it in the machine direction as the bag is made, thus requiring inexpensive rotary tooling that will not negatively impact line speed.

These and other objects of the present Invention will be more readily apparent when considered in reference to the following description and when taken in conjunction with the accompanying drawings.

SUMMARY OF THE INVENTION

In accordance with the present invention there is provided an improved top opening, rectangular flexible bag for containing a stack of highly compressed flexible articles. The bag has front and back panels, two side panels and top and bottom panels, all of which are connected together to form an internal compartment for containing the stack under high compression. The stack is arranged within the bag in such a way that the side panels are under tension. The line of weakness defines the entire top portion of the bag which can be easily removed, thus exposing the entire contents of the bag for easy removal. The improvement to the bag is that the line of weakness is applied to the front and back panel of the bag simultaneously, thus providing perfect alignment of the lines of weakness where they intersect the side seals of the bag. The bag is further improved with a notch where the line of weakness intersects the side seal, thus significantly reducing the force to initiate the tear through the bead of plastic created by the side seal. A further advantage of the invention Is that the line of weakness is applied in the machine direction as the bag in manufactured, thus requiring a simple, inexpensive, rotary cutting tool rather than an expensive, reciprocating die, and without negatively Impacting line speeds.

BRIEF DESCRIPTION OF THE DRAWINGS

While the specification concludes with claims particularly pointing out and distinctly claiming the present invention, it is believed that the present invention will be better understood from the foregoing description in conjunction with the accompanying drawings in which:

DETAILED DESCRIPTION OF THE INVENTION

While the present invention will be described in the context of providing an easy open flexible bag containing one or more stacks of folded, adult incontinent pads, the present invention is in no way limited to such application. As pointed out earlier herein, the present invention may be practiced to greatest advantage to provide reduced shipping, storage and handling costs in any situation involving flexible articles which are substantially compressible in at least one of their dimensions, such as their thickness. In addition, the present invention can be used to quickly dispense the entire contents of such a package, as is commonly done in hospitals and nursing homes. In addition, the present invention can be manufactured inexpensively relative to other types of flexible bag easy open features. The detailed description contained herein, which relates to a particularly preferred easy open flexible bag of compressed adult incontinent pads, will allow one skilled in the art to readily adapt the invention to other uses.

Figure 1:
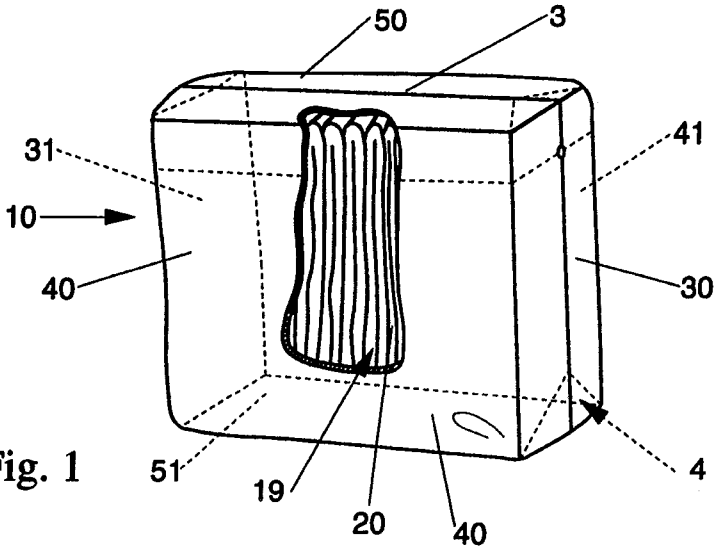
FIG. 1 is a simplified perspective view of a flexible bag In accordance with the present invention.

FIG. 1 is a simplified perspective view of a top sealed, top opening, gusseted, substantially rectangular flexible bag 10 in accordance with the present invention. Bag 10 contains a number of compressed flexible articles 20 arranged in a stack. Bag 10 comprises opposing front and back panels 40 and 41, opposing side panels 30 and 31, and opposing top and bottom panels 50 and 51. Top panel 50 is formed after bag 10 is loaded and sealed. Bottom panel 51 comprises the gusset produced by the bag manufacturer. All of the aforementioned panels are connected together to form an internal compartment 19 for containing the stack of compressed flexible articles 20 under high compression. The stack of compressed articles 20 is placed in bag 10 in such a way that side panels 30 and 31 are under tension.

Flexible bag 10 is a gusseted bag formed by folding a web of film, paper, plastic or other suitable material. The general method for forming gusseted, flexible bags from a continuous web of material is well known in the art. The general method for constructing and filling gusseted, flexible bags similar to those of the present invention is given in the earlier incorporated U.S. Pat. No. 5,054,619, SIDE OPENING FLEXIBLE BAG WITH LONGITUDINALLY ORIENTED CARRYING HANDLE SECURED TO SIDE PANELS, issued to Muckenfuhs on Oct. 8, 1991.

The improvement to the flexible bag 10 in accordance with the present invention includes the method of loading the flexible articles 20 into the bag 10. The articles 20 are loaded open end first rather than folded end first into bag 10. The articles 20 open ends are then in contact with bottom panel 51 and gusset 4. The articles 20 folded ends are in contact with the top panel 50 and sealed end 3. The articles 20 folded ends are thus exposed for easy dispensing from bag 10 after bag 10 is opened, shown in FIG. 3. Orientation of bag 10 in this manner positions the top seal 3 and bottom gusset 4 as convenient surfaces to grip while opening bag 10, shown in FIG. 2.

Figure 2:
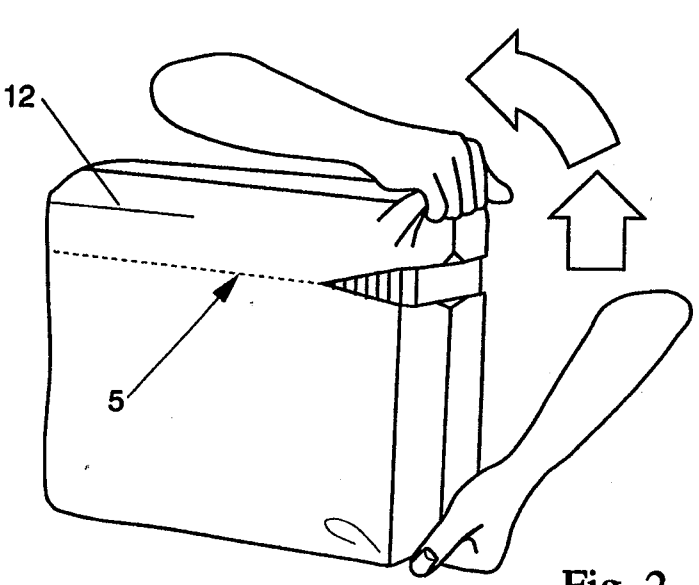
FIG. 2 is a simplified perspective view of a bag of the present invention showing how a consumer would grasp the top seal and bottom gusset to open the bag.

A further improvement to flexible bag 10 is the line of weakness 5 shown in FIG. 2, which traverses the entire perimeter of bag 10, and which, when activated, allows removal of the entire top portion 12 of bag 10. In such orientation, the line of weakness 5 is not stressed by articles 20 which are under compressive forces which are parallel rather than perpendicular to line of weakness 5. Line of weakness 5 can then be optimized with a greater ratio of cut (perforation) to uncut length, thus minimizing the force required to open bag 10.

Figure 3:
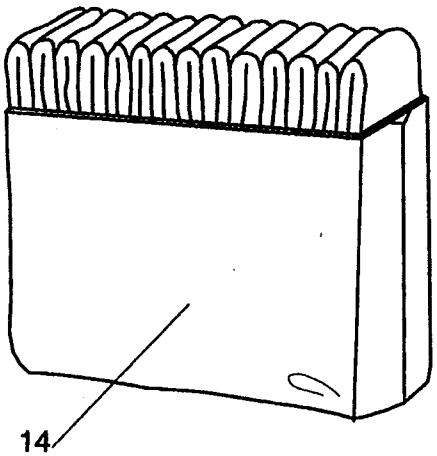
FIG. 3 is a view similar to that of FIG. 2 but showing the bag after it has been opened.

A further improvement to bag 10 results from removing the entire top portion 12 of bag 10, thus exposing the entire contents for removal, shown in FIG. 3. Articles 20 can then be easily removed in multiples, or bag 10 can be emptied in one motion by inverting bag 10, grasping side panels 30 and 31 and removing the entire bottom portion 14 of bag 10.

Figure 4:
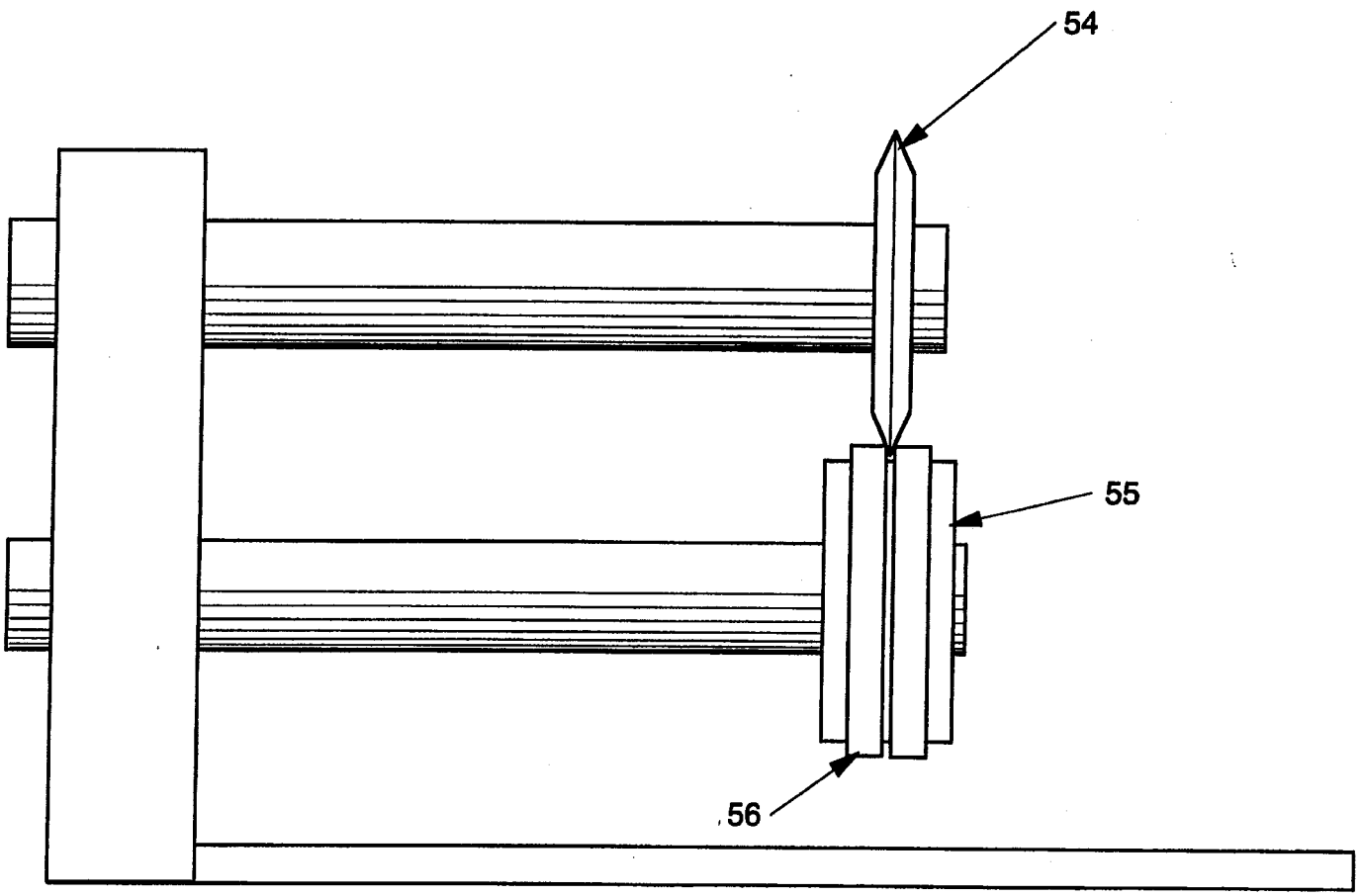
FIG. 4 is a simplified side view of the device used to produce the line of weakness.
Figure 5:
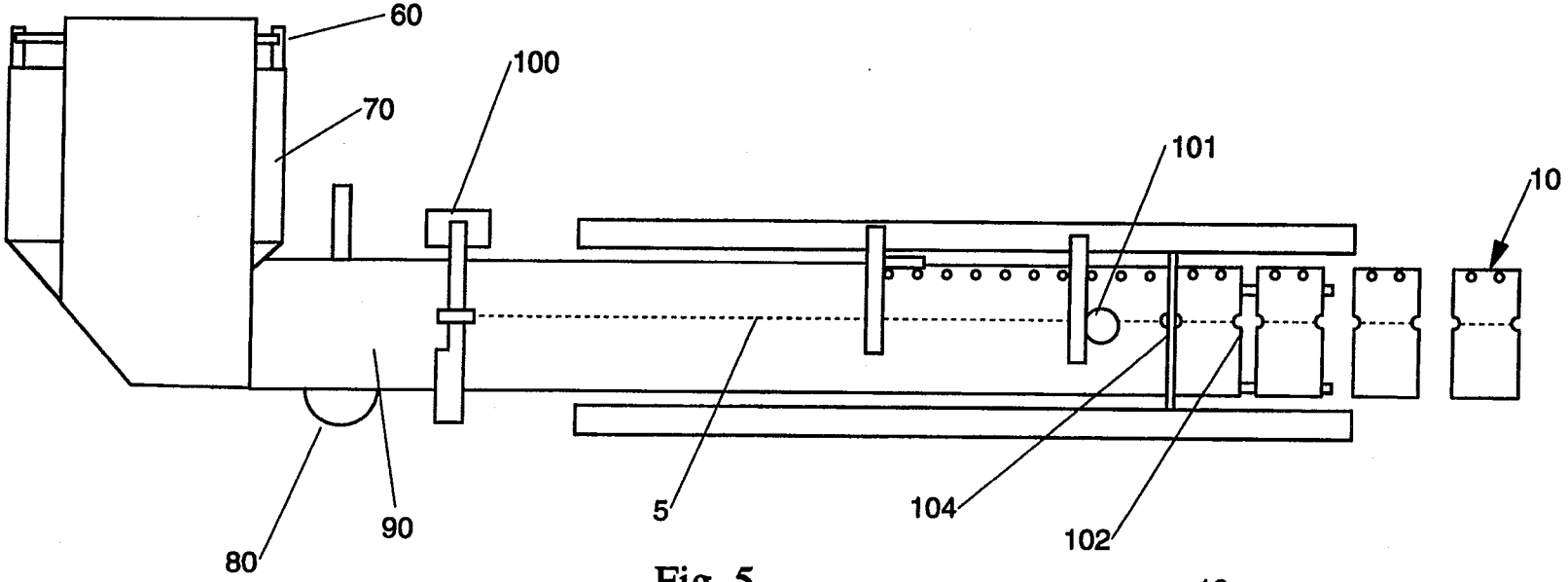
FIG. 5 is a simplified plan view of the bag manufacturing process showing where the line of weakness is produced and where the notch at the intersection of the line of weakness and the side seal is produced.

FIG. 4 is a simplified side view of the rotary cutting tool 54 used to produce the line of weakness 5 shown in FIGS. 2 and 5. In accordance with the present invention, perforating against a hardened steel roll 55 wrapped with a soft outer layer 56 facilitates a straight, uniform cut through two thicknesses of the flexible bag 10.

FIG. 5 is a simplified plan view of the bag manufacturing process. The flexible bag 10 is produced by unwinding a roll of film 60 over a folding board 70 to form the two sides of bag 10. The bottom gusset 4 is formed by the gusset wheel 80. Improvements to the line of weakness 5, in accordance with the present invention are as follows: The line of weakness 5 is produced downstream from roll unwind 60, folding board 70 and the gusset wheel 80, and is produced in the front and back panel of bag 10 simultaneously, thus eliminating any misalignment of line of weakness 5 between front and back panel of bag 10 which could be caused by carrying out those operations separately, and which misalignment could cause increased difficulty in opening the bag 10.

The easy open hole punch 101 produces notch 103 where the line of weakness 5 will intersect the side seal 102 of the flat bag. The side seal 102 is preferably formed by sealing bar 104 after formation of the notch 103. In accordance with the present invention, notch 103 significantly reduces the force required to initiate the opening feature by eliminating the need to tear through the bead of plastic formed at the side seal 102 of bag 10.

Figure 6:
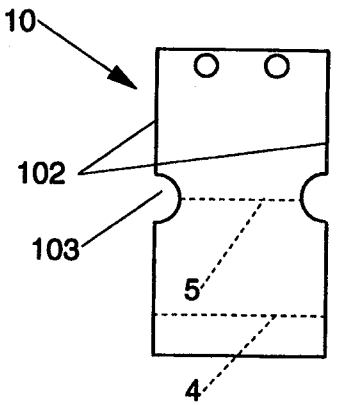
FIG. 6 shows a flat bag, illustrating the location of the line of weakness and the notch.

FIG. 6 shows a flat bag 10 illustrating the line of weakness 5 and easy open notch 103.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An easy open substantially rectangular flexible bag of compressed flexible articles, said flexible articles being arranged in a stack and held in compression in a direction substantially parallel to their thickness, said bag of articles comprising:

(a) a top half, a bottom half, a front and a back panel connected to one another by a pair of side panels, each of said side panels including a side seal, a bottom panel and a top panel, all of said panels being comprised of flexible material, said front, back, and side panels forming the sides of said bag, wherein said sides define a perimeter of said bag;

(b) a stack of compressed flexible articles with top and bottom portions, each of said articles having a pair of opposed, substantially planar surfaces, said articles being oriented so that said substantially planar surfaces are aligned substantially parallel to the side panels of said bag, said side panels and said front and back panels being subject to tension imposed by said stack of compressed flexible articles, said top and bottom panels being in a substantially untensioned condition; and (c) an easy open device comprising a substantially continuous line of weakness located around the perimeter of said bag in the top half of said bag, said line of weakness comprising serrations in said flexible material, said serrations passing completely through said front, back, and side panels, said serrations in said front panel further lying essentially on top of said serrations in said back panel when said bag is flat and unopened before said bag is loaded with said stack of compressed flexible articles, said easy open device further comprising a pair of notches in said side seals to facilitate the opening of said bag at said side seals, said notches passing completely through said side seals and into said side panels, said substantially continuous line of weakness defining a predetermined portion of said top half of said bag to be at least partially separated from the remainder of said bag without releasing the tension in the remainder of said bag, whereby said predetermined portion of said top half is at least partially separated from the remainder of said bag by applying a grasping force to said predetermined portion of said bag to propagate tears along said line of weakness, whereupon the top portion of the stack of articles is exposed for easy dispensing while the bottom portion of said stack coinciding with the remaining tensioned portion of said bag is retained in a substantially compressed condition.

* * * * *

UNITED STATES PATENT AND TRADEMARK OFFICE

CERTIFICATE OF CORRECTION

PATENT NO. : 5,380,094

DATED : January 10, 1995

INVENTOR(S) : Edward H. Schmidt et al.

It is certified that error appears in the above-identified patent and that said Letters Patent is hereby corrected as shown below:

| | |
|---|---|
| Column 1, line 29 | delete "canons" and insert --cartons--. |
| Column 1, line 58 | delete "am" and insert --are--. |

Signed and Sealed this

Twenty-sixth Day of January, 1999

*Attest:*

*Attesting Officer*

*Acting Commissioner of Patents and Trademarks*